US012426618B2

(12) United States Patent
Del Borrello

(10) Patent No.: US 12,426,618 B2
(45) Date of Patent: Sep. 30, 2025

(54) METHOD TO PRODUCE A SHEET OF MATERIAL CONTAINING ALKALOIDS

(71) Applicant: PHILIP MORRIS PRODUCTS S.A., Neuchatel (CH)

(72) Inventor: Michele Del Borrello, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 405 days.

(21) Appl. No.: 17/779,246

(22) PCT Filed: Nov. 30, 2020

(86) PCT No.: PCT/EP2020/083945

§ 371 (c)(1),
(2) Date: May 24, 2022

(87) PCT Pub. No.: WO2021/121933

PCT Pub. Date: Jun. 24, 2021

(65) Prior Publication Data

US 2022/0408785 A1 Dec. 29, 2022

(30) Foreign Application Priority Data

Dec. 18, 2019 (EP) ..... 19217400

(51) Int. Cl.
*A24B 3/14* (2006.01)
*A24B 15/14* (2006.01)
*A24B 15/167* (2020.01)

(52) U.S. Cl.
CPC ..... *A24B 15/14* (2013.01); *A24B 3/14* (2013.01); *A24B 15/167* (2016.11)

(58) Field of Classification Search
CPC ..... A24B 3/14; A24B 15/12; A24B 15/14; A24B 15/16
See application file for complete search history.

(56) References Cited

U.S. PATENT DOCUMENTS 2,592,554 A 4/1952 Frankenburg
3,012,914 A 12/1961 Battista
(Continued)

FOREIGN PATENT DOCUMENTS

CN 108 451 001 8/2018
SU 1654405 6/1991
(Continued)

OTHER PUBLICATIONS

PCT Search Report and Written Opinion for PCT/EP2020/083945 dated Feb. 11, 2021 (13 pages).
(Continued)

*Primary Examiner* — Eric Yaary
(74) *Attorney, Agent, or Firm* — Mueting Raasch Group

(57) ABSTRACT

The invention relates to a method for the preparation of a sheet of a material containing alkaloids, said method comprising: —grinding a material containing alkaloids to a powder; —combining the powder with a binder, an aerosol former and water, so as to form a slurry, wherein the slurry comprises: •the powder of the material containing alkaloids in an amount comprised between about 40 percent and about 70 percent of the total weight of the slurry; •the water in an amount comprised between about 30 percent and about 55 percent of the total weight of the slurry; •the binder in an amount comprised between about 0 percent and about 1 percent of the total weight of the slurry; •the aerosol former in an amount comprised between 1 percent and about 5 percent of the total weight of the slurry; —applying the slurry to a substrate sheet including fibres so as to form a sheet of a material containing alkaloids.

14 Claims, 6 Drawing Sheets

(56) References Cited

U.S. PATENT DOCUMENTS

| | | | | |
|---|---|---|---|---|
| 4,858,630 | A * | 8/1989 | Banerjee | A24B 15/165 131/369 |
| 5,499,636 | A | 3/1996 | Baggett | |
| 2005/0039767 | A1* | 2/2005 | Mua | A24B 3/14 131/370 |
| 2018/0242631 | A1* | 8/2018 | Klipfel | A24B 15/14 |
| 2018/0310608 | A1* | 11/2018 | Sciboz | A24B 15/14 |

FOREIGN PATENT DOCUMENTS

| | | |
|---|---|---|
| WO | WO 2016/067226 | 5/2016 |
| WO | WO 2018/197892 | 11/2018 |

OTHER PUBLICATIONS

Office Action issued in Russia for Application No. 2022116217/05 dated Feb. 7, 2024 (15 pages). English translation included.

* cited by examiner

METHOD TO PRODUCE A SHEET OF MATERIAL CONTAINING ALKALOIDS

This application is a U.S. National Stage Application of International Application No. PCT/EP2020/083945 filed Nov. 30, 2020, which was published in English on Jun. 24, 2021, as International Publication No. WO 2021/121933 A1. International Application No. PCT/EP2020/083945 claims priority to European Application No. 19217400.1 dated Dec. 18, 2019.

This invention relates to a method for producing a sheet of a material containing alkaloids.

In particular, the material containing alkaloids may be a homogenized tobacco material, preferably used in an aerosol-generating article such as, for example, a cigarette or a "heat-not-burn" type tobacco containing product.

Today, in the manufacture of tobacco products, besides tobacco leaves, also homogenized tobacco material is used, like cast leaf or reconstituted tobacco.

In a "heat-not-burn" aerosol-generating article, an aerosol-forming substrate is heated to a relatively low temperature, in order to form an aerosol but prevent combustion of the tobacco material.

The homogenized tobacco material is produced by mixing different components, including tobacco powder, to form a tobacco slurry. Further, the slurry commonly contains fibres, such as cellulose fibres, in addition to those contained in the tobacco. This slurry is then stored in tanks before being sent, through a suitable delivery system, to a casting system where it enters a "casting box" to be cast on a moving conveyor steel belt and then dried into a dryer.

There is a need for a process to obtain an alternative material containing alkaloids which can be used for heat-not-burn products.

In an aspect, the invention relates to a method for the production of a sheet of a material containing alkaloids, said method comprising: grinding a material containing alkaloids to a powder; and combining the powder with a binder, an aerosol former and water, so as to form a slurry. Preferably, the slurry comprises: the powder of the material containing alkaloids in an amount comprised between about 40 percent and about 70 percent of the total weight of the slurry. Preferably, the slurry comprises the water in an amount comprised between about 30 percent and about 55 percent of the total weight of the slurry. Preferably, the slurry comprises the binder in an amount comprised between about 0 percent and about 1 percent of the total weight of the slurry. Preferably the slurry comprises the aerosol former in an amount comprised between 1 percent and about 5 percent of the total weight of the slurry. The method may further comprise applying the slurry to a substrate sheet including fibres so as to form a sheet of a material containing alkaloids.

The slurry is supplied to a substrate sheet which includes fibres to form a sheet of material containing alkaloids. A "fibres' substrate" for the slurry is thus already present and there is no need to add a high amount of fibres in the slurry to obtain a sheet of a material including alkaloids with a relatively high tensile strength. This aspect may allow to use less water in the slurry and thus also less energy in drying the resulting sheet of a material containing alkaloids. A better control of the composition of the sheet may be achieved as well.

As used herein, the terms "sheet" denotes a laminar element having a width and length substantially greater than the thickness thereof.

As used herein, the term "slurry" denotes a liquid-like, viscous or pasty material that may comprise an emulsion of different liquid-like, viscous or pasty material. The slurry may contain a certain amount of solid-state particles, provided that the slurry still shows a liquid-like, viscous or pasty behavior.

In the following, with the term "upstream" or "downstream", reference is made to the direction of flow of the slurry.

As used herein, the term "movable support" denotes any means comprising a surface adapted to be moved in at least one longitudinal direction. The movable support may form a closed loop so as to provide an uninterrupted transporting ability in one direction. However, the movable support may be moved in a reciprocating way as well. The movable support may include a conveyor belt. The movable support may be essentially flat. The movable support may show a structured or an unstructured surface. The movable support may comprise a sheet-like movable and bendable band. The band may be made of a metallic material, including but not limited to steel, copper, iron alloys and copper alloys, or of rubber.

"Substrate sheet including fibres" denotes a sheet used as a substrate for the slurry and formed in a material including fibres. The material in which the sheet is formed may include any type of fibres, for example cellulose fibres. The sheet of a material may be placed on top of a movable support or it may be self-supporting.

A "material containing alkaloids" is a material which contains one or more alkaloids. The alkaloids may comprise nicotine. The nicotine may be found, for example, in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Caffeine, nicotine, theobromine, atropine, tubocurarine are examples of alkaloids.

As used herein, the term "homogenized tobacco material" denotes material formed by agglomerating particulate tobacco, which contains the alkaloid nicotine. The material containing alkaloids can thus be a homogenized tobacco material.

The most commonly used forms of homogenized tobacco material is reconstituted tobacco sheet and cast leaf. The process to form homogenized tobacco material sheets commonly comprises a step in which tobacco powder and a binder, are mixed to form a slurry. The slurry is then used to create a tobacco sheet, for example by casting a viscous slurry onto a moving metal belt to produce so called cast leaf. Alternatively, a slurry with low viscosity and high water content can be used to create reconstituted tobacco in a process that resembles paper-making.

The sheet material of tobacco can be referred to as a reconstituted sheet material and formed using particulate tobacco or a particulate tobacco blend, a humectant and an aqueous solvent to form the tobacco composition.

The homogenized tobacco sheet generally includes, in addition to the tobacco, a binder such as guar. The homogenized tobacco sheet may also include an aerosol-former, such as glycerin.

The term "aerosol-forming substrate" refers to a substrate that is capable of releasing volatile compounds that may form an aerosol. Typically, aerosol-forming substrates release volatile compounds upon heating. The aerosol-forming substrate may include the material containing alkaloids containing volatile alkaloids flavor compounds, which are released from the aerosol-forming substrate upon heating. The aerosol-forming substrate may include homogenized material.

As used herein, the term "aerosol-generating device" refers to a device configured to interact with an aerosol-forming substrate to generate aerosol. Preferably, the aerosol-generating device includes an aerosolizer, such as a heater.

The sheet of material containing alkaloids is thus a sheet which is formed in a material which contains any alkaloid or a combination of more than one alkaloid. The width of the sheet of material containing alkaloids is preferably greater than about 10 millimeters, more preferably greater than about 20 millimeters or about 30 millimeters. Even more preferably, the width of the sheet of material containing alkaloids is comprised between about 60 millimeters and about 2500 millimeters. The thickness of the sheet of material containing alkaloids is preferably comprised between about 50 micrometers and about 300 micrometers, more preferably the thickness of the sheet is comprised between about 100 micrometers and about 250 micrometers, even more preferably between about 130 micrometers and 220 micrometers.

The sheet of material containing alkaloids may be used as aerosol-forming substrate for an aerosol generating device. The sheet of material containing alkaloids may include a homogenized tobacco sheet.

In order to produce a sheet of material containing alkaloids, a material containing alkaloids is grinded to a powder. Due to the fact that preferably the slurry does not contain, or contain a very small amount, of cellulose fibres in addition of those already contained in the material containing alkaloids, the size of the powder does not need to be "extremely small". In order to obtain an homogeneous slurry, particles of material containing alkaloids are preferably "small". The small size is also due to the absence of added fibres which act as "glue" in a cast leaf. Preferably, the size of the grinded particles of material containing alkaloids have a size smaller than 200 microns, preferably smaller than 180 microns, preferably smaller than 160 microns, preferably smaller than 140 microns, preferably smaller than 120 microns, preferably smaller than 100 microns, preferably smaller than 80 microns, preferably smaller than 60 microns, preferably smaller than 40 microns. Preferably, the size of the grinded particles of material containing alkaloids have a size larger than 8 microns, preferably larger than 12 microns, preferably larger than 20 microns, preferably larger than 30 microns, preferably larger than 50 microns, preferably larger than 70 microns. Preferably, the step of grinding a material containing alkaloids to a powder includes grinding the material containing alkaloids to a powder having a size comprised between about 8 microns and 200 microns. More preferably, the step of grinding a material containing alkaloids to a powder includes grinding the material containing alkaloids having a size comprised between about 10 microns and 150 microns. Even more preferably, the step of grinding a material containing alkaloids to a powder includes grinding the material containing alkaloids having a size comprised between about 15 microns and 120 microns.

With size of the particle of the material containing alkaloids, the Dv95 size is meant. Each of the values above listed indicates the Dv95 of the particle size. The "v" in Dv95 means that a volume distribution is considered. The use of volume distributions introduces the concept of the equivalent sphere. An equivalent sphere is a sphere which is equal to the real particle in the property which we are measuring. Thus for light scattering methods, it is a sphere which would produce the same scattering intensities as the real particle. This is substantially a sphere having the same volume of the particle. Further, "95" in Dv95 means the diameter where ninety-five percent of the distribution has a smaller particle size and five percent has a larger particle size. Thus the particle size is that size according to a volume distribution where 95 percent of the particles have a diameter (of the corresponding sphere having substantially the same volume of the particle) smaller than the stated value. A particle size of 60 microns means that 95 percent of the particles have a diameter smaller than 60 microns, where the diameter is the diameter of the sphere having a corresponding volume than the particle.

The Dv95 size of the particle is measured using a Horiba LA 950 or LA 960 particle size distribution analyser. The HORIBA LA-960 particle size analyser uses the laser diffraction method to measure size distributions. This technique uses first principles to calculate size using light scattered off the particle (edge diffraction) and through the particle (secondary scattering refraction). The LA-960 incorporates the Mie scattering theory.

The powder obtained by the grinding step is used in forming a slurry.

The slurry may comprise a number of different components or ingredients. These components may influence the properties of the cast sheet of material containing alkaloids. A first ingredient is a material containing alkaloids, in powder form. This material can be for example a tobacco powder blend. Preferably the tobacco powder blend contains the majority of the tobacco present in the slurry. This way, the tobacco powder blend is the source of the majority of tobacco in the homogenized tobacco material. As such, the tobacco powder blend defines the flavor to the final product, for example to an aerosol produced by heating the homogenized tobacco material. The amount of material containing alkaloids in the slurry is preferably comprised between about 40 percent and about 70 percent of the total mass of the slurry, that is, of the mass of the slurry including water. Preferably, the material containing alkaloids is in powder form. More preferably, the amount of material containing alkaloids in the slurry is preferably comprised between about 40 percent and about 50 percent of the total mass slurry, that is, of the mass of the slurry including water.

A binder is preferably added to the slurry, in order to enhance the tensile properties of the homogenized sheet.

The quantity of binder present in the slurry may be comprised between about 0 percent and about 1 percent of the total mass of the slurry, that is, of the mass of the slurry including water. More preferably, the quantity of binder present in the slurry is comprised between about 0 percent and about 0.5 percent of the total mass of the slurry. The amount of binder may depend on the desired characteristics of the sheet of material containing alkaloids. If it is desired that the slurry is greatly absorbed by the substrate sheet, then less binder may be used to improve absorption. If a slurry coating on the substrate sheet is preferred, a higher amount of binder may be used. The amount of binder may vary the viscosity of the slurry. A higher amount of binder may lead to a higher viscosity of the slurry.

The binder used in the slurry may be any of the gums or pectins described herein. The binder may ensure that the alkaloid powder remains substantially dispersed throughout the sheet of material containing alkaloids. Although any binder may be employed, preferred binders are natural pectins, such as fruit, citrus or tobacco pectins; guar gums, such as hydroxyethyl guar and hydroxypropyl guar; locust bean gums, such as hydroxyethyl and hydroxypropyl locust bean gum; alginate; starches, such as modified or derivitized starches; celluloses, such as methyl, ethyl, ethylhydroxymethyl and carboxymethyl cellulose; tamarind gum; dextran; pullalon; konjac flour; xanthan gum and the like. The particularly preferred binder for use in the present invention is guar.

An aerosol former is preferably added to the slurry to promote the formation of aerosol.

Suitable aerosol formers for inclusion in slurry for sheet of material containing alkaloids are known in the art and include, but are not limited to: monohydric alcohols like menthol, polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Examples of preferred aerosol formers are glycerine and propylene glycol.

The slurry may have an aerosol former content comprised between about 1 percent and about 5 percent of the total mass of the slurry, that is, of the mass of the slurry including water. Preferably, it is comprised between 1 and 3 percent of the total mass of the slurry that correspond to an amount of aerosol-former comprised between about 2.9 percent and about 8.5 percent on a dry weight basis of the slurry.

Water is also preferably present in the slurry, in order to reach a certain viscosity and moisture for applying the slurry to a substrate sheet. The amount of water is preferably comprised between about 30 percent and 55 percent of the total mass of the slurry, that is, of the mass of the slurry including water. More preferably, the amount of water is comprised between about 45 percent and about 55 percent of the total mass of the slurry, that is, of the mass of the slurry including water.

The material containing alkaloids, preferably in powder form, may contain cellulose. However, preferably, there are no added cellulose fibres in the slurry, that is, besides the fibres already contained in the material containing alkaloids, no further fibres are added in the slurry. Therefore, the amount of added (that is, in addition to those already contained in the material containing alkaloids) fibres to the slurry is preferably lower than 0.5 percent of the total mass of the slurry, that is, of the mass of the slurry including water. More preferably, the added fibres are present in a quantity lower than about 0.1 percent of the total mass of the slurry.

The slurry is formed in a given location. The slurry may be then stored. The slurry may be for example stored and formed in the same location, for example in the same storing tank, or in two different locations, for example in two different storing tanks. The storing tank used is preferably known in the field. Further, the slurry can be formed or stored in a single storing tank, or in a plurality of storing tanks. Preferably, in the storing tank, a mixer is present to homogenize the slurry.

Further, a substrate sheet including fibres is provided. The substrate sheet defines a surface on which the slurry is supplied from the tank. The substrate sheet may be provided in bobbin which is unwound.

During operation, the substrate sheet moves along a transport direction.

Preferably the tank includes an outlet positioned above the substrate sheet.

The substrate sheet including fibres typically is a relatively "strong" sheet, the tensile strength of which is such that it can be transported between rollers, without the need of any additional substrate on which it has to be in contact with. The tensile strength of the substrate sheet is preferably comprised between about 0.1 Newton/(millimetres)$^2$ and about 1 Newton/(millimetres)$^2$.

The substrate sheet may be made of different materials, natural or synthetic, including cellulose, hemp, kenaf, bamboo pulp, wood, cotton, silk, or combination thereof. The selection of the material is done according to the mechanical properties expected for the final sheet including a material containing alkaloids.

The fibres in the substrate sheet may be woven. The fibres in the substrate sheet may be not woven. If not woven, the fibres may be predominantly oriented in one direction. Alternatively, the fibres may be randomly oriented. If woven, various patterns could be used.

The substrate sheet defines a first and a second surface, one opposite to the other. Either the first surface or the second surface, or both, may be a substantially planar surface. The first surface or second surface, or both, may be horizontal, that is, parallel to an horizontal plane. The first surface or second surface, or both, may be tilted with respect to an horizontal plane. The first surface or second surface, or both, may also be substantially vertical.

Preferably, the slurry is applied to the first surface of the substrate sheet. In order to apply or distribute the slurry present in the tank to the first surface of the substrate sheet, the substrate sheet needs to be moved, so that the slurry is applied to the first surface along its length, forming a strip of slurry on the substrate sheet including fibres.

The slurry does not need to be applied to the whole first surface. The slurry can be applied only to part of the first surface, for example to a central portion of the first surface.

Preferably, therefore, the substrate sheet is moved along the transport direction, such as for example linearly moved, and a part of the first surface of the substrate sheet enters into contact with the slurry.

The slurry which comes into contact with the substrate sheet may be completely absorbed by the substrate sheet. The slurry may form a coating on the first surface of the substrate sheet. The slurry may also be partly absorbed by the substrate sheet and partly coat the first surface of the substrate sheet. The resulting sheet formed by the substrate sheet and the slurry may have a different composition in a cross section taken perpendicularly to the first surface of the substrate sheet. At the second surface, the lowest concentration of slurry may be present. At the first surface, the highest concentration of slurry may be present. In between the first surface and the second surface, a combination of substrate sheet's material and slurry may be present in different concentrations.

The slurry may be applied to both the first and the second surface. The composition of the sheet of material containing alkaloids may be symmetrical. The concentration of fibres per unit volume of the sheet of material containing alkaloids may be highest at the centre of the sheet of material containing alkaloids and lowest at the first surface and second surface.

In order to move the substrate sheet along the transport direction, a moving element may be provided.

The moving element may include a movable support and the substrate sheet including fibres may be positioned on the movable support, so that the movable support, while moving, transports the substrate sheet.

In another embodiment, the moving element may include a moving drum, which—in its rotation—moves the substrate sheet. The support sheet may be free standing for a portion of its length.

The amount of slurry in the tank is preferably kept substantially constant. For example, the amount of slurry in the tank is equal to a pre-defined quantity. Preferably, the pre-defined quantity of amount of slurry in the tank is maintained constant. For example, a pre-determined level of slurry within the tank is set. In order to obtain a substantially constant level of slurry in the tank, slurry is continuously supplied to the tank while the slurry is supplied onto the substrate sheet. The level of slurry in the tank may be checked by means of a sensor and the amount of slurry provided by the extruder into the tank may be varied to maintain the level in the tank constant.

From the outlet of the tank, the slurry is supplied onto the substrate sheet. The slurry forms a deposit on the substrate sheet's first surface.

Further, due to the movement of the substrate sheet in the transport direction, the slurry supplied from the outlet forms a strip of slurry. The combination of substrate sheet and a strip of slurry provided on its first surface forms a sheet of material containing alkaloids. If slurry is applied to both the first and the second surfaces, the combination of the substrate sheet and the slurry strips provided on the first surface and on the second surface forms a sheet of material containing alkaloids.

Further, more than one strip of slurry may be applied on the same surface of the substrate sheet. For example, two or more strips of slurry may be applied on the first surface of the substrate sheet. The strips of slurry may be parallel to each other. The substrate sheet having multiple strips of slurry may be then slit in order to form multiple sheets of material containing alkaloids. Two or more parallel strips of slurry may be applied on the second surface of the substrate sheet as well.

In addition to the substrate sheet and the strip or strips of slurry, other elements may be combined in order to form the sheet of material containing alkaloids. The substrate sheet itself may be a multilayered sheet. The substrate sheet may include a flavor sheet, a sheet of material comprising alkaloids (for example nicotine), and others.

Forming a sheet of material containing alkaloids supplying slurry onto an already formed substrate sheet including fibres allows to use substantially no added fibres in the slurry, or a very limited amount of added fibres. Fibres are commonly added in the slurry of a prior art cast sheet in order to increase the tensile strength of the sheet, acting as a strengthening agent.

However, the presence of a substrate sheet on which the slurry is supplied provides sufficient tensile strength to the resulting sheet of material containing alkaloids. The cellulose fibres' addition into the slurry may be avoided.

In slurry where fibres are added, a relatively high amount of water may be required, because water is needed for the fibres pulping. In addition, due to the large amount of water present in the slurry, a high amount of energy is needed in order to dry the slurry and form a sheet of the material containing alkaloids. In this "high water content" process, the conveyor steel belt on which the slurry is casted may also play an important role: any imperfection in the conveyor belt may be transferred to the cast sheet, thus a high quality belt is often required. Removing the added fibres from the slurry allows to decrease the amount of water which is needed to homogenize the slurry. A certain amount of water may still be needed for good homogenization. This relatively "dense" slurry is suitable to be applied to the substrate sheet including fibres.

Less drying time or less drying power is required for drying the sheet of material including alkaloids produced according to the invention. The substrate sheet is preferably already dried when it is wound in a bobbin. The substrate sheet may be wetted, for example spraying water on it, before contacting the slurry. The wetting is done to facilitate the penetration of the slurry in the substrate sheet. The resulting multilayered sheet of material containing alkaloids or sheet of composite material containing alkaloids is only "partly wet" and the drying time or the required amount of energy for drying is comparatively low. A less "intense" drying allows to have a better control on the flavour of the aerosol produced by the sheet of material containing alkaloids when used as an aerosol forming substrate. During drying, alkaloids, flavours or other volatiles may evaporate and their concentration in the sheet of material containing alkaloids may be reduced. Minimizing the drying when the alkaloids are present helps to control the aerosol characteristics. Smaller dryers may be required compared to those used for drying cast leaf. Energy may be saved. Floor space may be saved.

Preferably, the method comprises the step of: drying the sheet of a material containing alkaloids to obtain a dry sheet of material containing alkaloids. The sheet of material containing alkaloids is dried. Preferably, the drying ends when the water content in the sheet is comprised between about 7 percent and about 15 percent in the total weight of the sheet of material containing alkaloids. Due to the fact that the sheet of material containing alkaloids can be "self-supporting", drying of the sheet may be uniform and may take place on both surfaces of the sheet in the same way. In a cast sheet according to the prior art, where the sheet is cast on a movable support, the surface of the sheet in contact with the support may dry differently than the surface of the sheet which is free, that is, in contact with air only. In the present invention, the slurry applied to the substrate sheet may form a self-supporting sheet of material containing alkaloids, so that the drying may be uniform and the same on both opposite surfaces of the sheet.

Preferably, the step of grinding a material containing alkaloids to a powder comprises grinding a blend of tobacco of one or more tobacco types to a tobacco powder. More preferably, the method also comprises the step of blending tobacco of one or more tobacco types of the following tobaccos: Bright tobacco; Dark tobacco; Aromatic tobacco; and Filler tobacco. The blending may take place before grinding. The blending may take place after grinding.

Preferably, the step of grinding a material containing alkaloids to a powder includes grinding a material containing alkaloids to a powder having a size comprised between about 8 microns and 200 microns. More preferably, the step of providing a slurry including a material containing alkaloids, an aerosol former and water comprises the step of: grinding a material containing alkaloids to a powder having a size comprised between about 10 microns and 150 microns. Even more preferably, the step of providing a slurry including a material containing alkaloids, an aerosol former and water comprises the step of: grinding a material containing alkaloids to a powder having a size comprised between about 15 microns and 120 microns. With size of the particle of the material containing alkaloids, the Dv95 size is meant. Due to the fact that the slurry does not contain, or contain a very small amount, of cellulose fibres in addition of those already contained in the material containing alkaloids, the size of the powder does not need to be "extremely small". Indeed, the absence of added fibres allows to obtain a homogeneous slurry also with "bigger" particles than those used in cast leaf where fibres are added to the slurry. In order to obtain an homogeneous slurry, particles of material containing alkaloids are preferably "small". Preferably, the size of the grinded particles of material containing alkaloids have a size smaller than 200 microns, preferably smaller than 180 microns, preferably smaller than 160 microns, preferably smaller than 140 microns, preferably smaller than 120 microns, preferably smaller than 100 microns, preferably smaller than 80 microns, preferably smaller than 60 microns, preferably smaller than 40 microns. Preferably, the size of the grinded particles of material containing alkaloids have a size larger than 8 microns, preferably larger than 12 microns, preferably larger than 20 microns, preferably larger than 30 microns, preferably larger than 50 microns, preferably larger than 70 microns. With size of the particle of the material containing alkaloids, the Dv95 size is meant.

In the present invention, the slurry is preferably formed by tobacco lamina and stem of different tobacco types, which are properly blended. Preferably, more than one tobacco type is blended together. For example, at least two different tobacco types are blended together. With the term "tobacco type" one of the different varieties of tobacco is meant. With respect to the present invention, these different tobacco types are distinguished in three main groups of bright tobacco, dark tobacco and aromatic tobacco. The distinction between these three groups is based on the curing process the tobacco undergoes before it is further processed in a tobacco product.

Bright tobaccos are tobaccos with a generally large, light coloured leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio. From a sensorial perspective, bright tobacco is a tobacco type which, after curing, is associated with a spicy and lively sensation. According to the invention, bright tobaccos are tobaccos with a content of reducing sugars of between about 2.5 percent and about 20 percent on dry weight basis of the leaf and a total ammonia content of less than about 0.12 percent on dry weight basis of the leaf. Reducing sugars comprise for example glucose or fructose. Total ammonia comprises for example ammonia and ammonia salts.

Dark tobaccos are tobaccos with a generally large, dark coloured leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. According to the invention, dark tobaccos are tobaccos with a content of reducing sugars of less than about 5 percent of dry weight base of the leaf and a total ammonia content of up to about 0.5 percent of dry weight base of the leaf.

Aromatic tobaccos are tobaccos that often have small, light coloured leaves. Throughout the specification, the term "aromatic tobacco" is used for other tobaccos that have a high aromatic content, for example a high content of essential oils. From a sensorial perspective, aromatic tobacco is a tobacco type which, after curing, is associated with spicy and aromatic sensation. Example for aromatic tobaccos are Greek Oriental, Oriental Turkey, semi-oriental tobacco but also Fire Cured, US Burley, such as Perique, Rustica, US Burley or Meriland.

Additionally, a blend may comprise so called filler tobaccos. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cured Brazil lower stalk.

Within each type of tobaccos, the tobacco leaves are further graded for example with respect to origin, position in the plant, colour, surface texture, size and shape. These and other characteristics of the tobacco leaves are used to form a tobacco blend. A blend of tobacco is a mixture of tobaccos belonging to the same or different types such that the tobacco blend has an agglomerated specific characteristic. This characteristic can be for example a unique taste or a specific aerosol composition when heated or burned. A blend comprises specific tobacco types and grades in a given proportion one with respect to the other.

According to the invention, different grades within the same tobacco type may be cross-blended to reduce the variability of each blend component. According to the invention, the different tobacco grades are selected in order to realize a desired blend having specific predetermined characteristics. For example, the blend may have a target value of the reducing sugars, total ammonia and total alkaloids per dry weight base of the homogenized tobacco material. Total alkaloids are for example nicotine and the minor alkaloids including nornicotine, anatabine, anabasine and myosmine.

For example, bright tobacco may comprise tobacco of grade A, tobacco of grade B and tobacco of grade C. Bright tobacco of grade A has slightly different chemical characteristics to bright tobacco of grade B and grade C. Aromatic tobacco may include tobacco of grade D and tobacco of grade E, where aromatic tobacco of grade D has slightly different chemical characteristics to aromatic tobacco of grade E. A possible target value for the tobacco blend, for the sake of exemplification, can be for example a content of reducing sugars of about 10 percent in dry weight basis of the total tobacco blend. In order to achieve the selected target value, a 70 percent bright tobacco and a 30 percent aromatic tobacco may be selected in order to form the tobacco blend. The 70 percent of the bright tobacco is selected among tobacco of grade A, tobacco of grade B and tobacco of grade C, while the 30 percent of aromatic tobacco is selected among tobacco of grade D and tobacco of grade E. The amounts of tobaccos of grade A, B, C, D, E which are included in the blend depend on the chemical composition of each of the tobaccos of grades A, B, C, D, E so as to meet the target value for the tobacco blend.

The various tobacco types have different chemical characteristics. It is believed that more than 300 chemical constituents are present in tobacco leaves. Within the same type of tobacco, different grades may also have differences in chemical composition. The chemical constituents of tobacco may be influenced by genetics, agricultural practice, soil type and nutrients, weather conditions, plant disease, stalk position, harvesting and curing procedures.

Preferably, the step of applying the slurry to a substrate sheet including fibres comprises providing a substrate sheet including cellulose fibres. The substrate sheet may be made of different materials, natural or synthetic, including cellulose, hemp, kenaf, bamboo pulp, cotton, silk, or combination thereof. The selection of the material is done according to the mechanical properties expected for the final sheet including a material containing alkaloids.

The fibres' content in the substrate sheet is preferably lower than 50 grams/(meter)$^2$.

The substrate sheet preferably includes cellulose fibres. Cellulose fibres forming the sheet are known in the art and include, but are not limited to: soft-wood fibres, hard wood fibres, jute fibres, flax fibres, tobacco fibres and combination thereof. In addition to pulping, the cellulose fibres might be subjected to suitable processes such as refining, mechanical pulping, chemical pulping, bleaching, sulphate pulping and combination thereof. Cellulose fibres may include tobacco stem materials, stalks or other tobacco plant material. Preferably, cellulose fibres such as wood fibres comprise a low lignin content. Alternatively fibres, such as vegetable fibres, may be used either with the above fibres or in the alternative, including hemp and bamboo.

Preferably, the step of applying the slurry to a substrate sheet including fibres comprises applying the slurry to a substrate sheet including fibres having a mean fibre length comprised between about 0.7 millimetres and about 50 millimetres. More preferably, the fibres of the substrate sheet including fibres have a mean fibre length comprised between about 1 millimetres and about 25 millimetres. More preferably, the fibres of the substrate sheet including fibres have a mean fibre length comprised between about 1 millimetres and about 10 millimetres. More preferably, the fibres of the substrate sheet including fibres have a mean fibre length comprised between about 1 millimetres and about 5 millimetres. Even more preferably, the fibres of the substrate sheet including fibres have a mean fibre length comprised between about 1.2 millimetres and about 1.8 millimetres.

The mean length of the fibers refers to their real length (regardless whether they are curled or have kinks) as measured by MORFI COMPACT commercialised by Techpap SAS. The mean length is the mathematical mean of the measured length of the fibers by MORFI COMPACT over a measurement of N fibers, where N>5. The MORFI COMPACT is a fiber analyser that measures the length of the fibers following the framework of the fibers, thus measuring their real developed length. Measured objects are considered fibers if their length is comprised between 200 microns and 10000 microns and their width is comprised between 5 microns and 75 microns. Fibers length is measured when deionized water is added to the fibers and Morfi software is used.

Preferably, the substrate sheet is a braided sheet. A braided sheet is a sheet where the fibres are intertwined. Not all fibres need to be intertwined, but a fraction thereof. A braided sheet allows to obtain an uniform and relatively high mechanical strength.

Preferably, the step of applying the slurry to a substrate sheet including fibres so as to form a sheet of a material containing alkaloids comprises coating or impregnating the substrate sheet with the slurry. More preferably, the step of coating or impregnating the substrate sheet with the slurry comprises coating or impregnating the substrate sheet by means of a roller. The slurry may be applied to the substrate sheet in many different ways. For example, a roller can be in contact with the slurry and it may apply the slurry to the substrate sheet while rotating. The rotation, combined with the substrate sheet's movements, may spread the slurry onto the substrate sheet. Depending on the composition of the substrate sheet or the composition of the slurry, or of both the compositions of the substrate sheet and of the slurry, for example depending on the amount of water or of binder contained in the slurry, the slurry may be absorbed minimally, in part, or for the most part by the substrate sheet. If the slurry is absorbed only minimally or in part by the substrate sheet, a layer of slurry is formed on the surface of the substrate sheet where the slurry is applied. A coating layer of slurry may be then formed on the surface of the substrate sheet. On the other hand, if a sorption process takes place, where slurry is absorbed or adsorbed by the substrate sheet, the substrate sheet becomes impregnated by slurry. The slurry can be completely absorbed by the substrate sheet. The slurry may also form both a coating layer and impregnate the substrate sheet.

The roller in contact with the slurry and applying slurry to the substrate sheet defines an external surface. The external surface may be made in a sponge-like material, for example an open cell foam, which absorbs the slurry. The substrate sheet may then use a capillary effect to absorb the slurry, so that an impregnation process takes place in the substrate sheet.

The external surface of the roller may be a non-porous rough surface. The roughness may help in coating the external surface of the roller with slurry. The substrate sheet adsorbs the slurry deposited on it by the roller. In such case, this is a coating process and the substrate sheet does not need to be in a material having capillary action.

Sorption is a physical and chemical process by which one substance becomes attached to another. Specific cases of sorption are: absorption, where the incorporation of a substance in one state into another of a different state takes place, such liquid slurry being absorbed by a solid substrate sheet; or adsorption, where the physical adherence or bonding of ions and molecules onto the surface of another phase takes place.

Depending on whether the substrate sheet gets impregnated by the slurry and in which amount, the composition of the resulting sheet of material containing alkaloids may vary depending on whether the analysis is performed externally on one of the surfaces of the sheet or internally, that is, along a cross section between the first and second surface.

Further, in addition to the roller, a coating layer of slurry, or an impregnation of the substrate sheet by slurry, may be obtained using other slurry's application means, for example a brush.

In addition, slurry may fall by gravity from an outlet of the tank where it is contained on the substrate sheet.

Preferably, the step of applying the slurry to a substrate sheet including fibres so as to form a sheet of a material containing alkaloids comprises spraying the slurry onto the substrate sheet. Preferably, a nozzle ejects the slurry from the tank onto the substrate sheet, preferably on a surface of the substrate sheet including fibres. The slurry present in the tank may be highly viscous, for example it may have a dynamic viscosity comprised between about 18000 Centipoises and about 45000 Centipoises and for this reasons preferably one or more pumps are provided in order to push the slurry towards the outlet of the tank. Preferably, a nozzle is positioned at the outlet of the tank and sprays the slurry onto the substrate sheet. More than one outlet, and in turn more than one nozzle, may be present.

Preferably, the substrate sheet has a thickness comprised between 0.175 millimetres and about 0.250 millimetres. The thickness of the substrate sheet is preferably so selected that the final thickness, when the slurry is applied to one or both of its surfaces, is the preferred thickness for the further processing of the sheet, such as crimping and gathering in a rod.

Preferably, the substrate sheet has a width comprised between about 100 millimetres and about 2500 millimetres. The width of the substrate sheet is chosen depending on the size of the bobbin to be obtained. Preferably, after the sheet of material containing alkaloids is formed, it is dried. Preferably, after drying, the sheet of material containing alkaloids is wound in a bobbin. The bobbin may be a "master bobbin" which is then slit into smaller bobbins. The bobbin may be already a bobbin used for further processing of the sheet of material containing alkaloids.

Preferably, the step of grinding a material containing alkaloids to a powder comprises grinding a material containing alkaloids to a powder having a size comprised between about 8 microns and 200 microns. More preferably, the step of providing a slurry including a material containing alkaloids, an aerosol former and water comprises the step of: grinding a material containing alkaloids to a powder having a size comprised between about 10 microns and 150 microns. Even more preferably, the step of providing a slurry including a material containing alkaloids, an aerosol former and water comprises the step of: grinding a material containing alkaloids to a powder having a size comprised between about 15 microns and 120 microns. Due to the fact that the slurry does not contain, or contain a very small amount, of cellulose fibres in addition of those already contained in the material containing alkaloids, the size of the powder does not need to be "extremely small". In order to obtain an homogeneous slurry, particles of material containing alkaloids are preferably "small". The small size is also due to the absence of added fibres which act as "glue" in a cast leaf. Preferably, the size of the grinded particles of material containing alkaloids have a size smaller than 200 microns, preferably smaller than 180 microns, preferably smaller than 160 microns, preferably smaller than 140 microns, preferably smaller than 120 microns, preferably smaller than 100 microns, preferably smaller than 80 microns, preferably smaller than 60 microns, preferably smaller than 40 microns. Preferably, the size of the grinded particles of material containing alkaloids have a size larger than 8 microns, preferably larger than 12 microns, preferably larger than 20 microns, preferably larger than 30 microns, preferably larger than 50 microns, preferably larger than 70 microns. With size of the particle of the material containing alkaloids, the Dv95 size is meant.

Preferably, the substrate sheet defines a first and a second surface and the step of applying the slurry to the substrate sheet comprises applying the slurry to the first and to the second surface of the substrate sheet. The slurry may be applied to one of the surfaces of the substrate sheet or on both the surfaces. This is possible because the substrate sheet may be self supporting and application of slurry on both opposite surfaces is possible at the same time.

Preferably, the method comprises the step of applying a flavour to the sheet of material containing alkaloids. Preferably, the method includes the step of applying further alkaloids to the sheet of material containing alkaloids. The flavour or the additional alkaloids, in addition to those already present in the grinded material containing alkaloids, may be applied to the substrate sheet or introduced in the slurry. Different sheets of material containing alkaloids having different properties may be produced.

The invention may also relate to an aerosol-generating article, comprising a portion of the sheet of material containing alkaloids realized according to the method described above. Aerosol forming articles according to the present invention may encompass articles in which material containing alkaloids is heated to form an aerosol, rather than combusted.

Aerosol forming articles according to the invention may be whole, assembled aerosol forming articles or components of aerosol forming articles that are combined with one or more other components in order to provide an assembled article for producing an aerosol, such as for example, the consumable part for a heated smoking device.

An aerosol forming article may resemble a conventional smoking article, such as a cigarette and may comprise tobacco. An aerosol forming article may be disposable. An aerosol forming article may alternatively be partially-reusable and comprise a replenisheable or replaceable aerosol forming substrate.

In preferred embodiments, the aerosol forming-article may be substantially cylindrical in shape. The aerosol forming article may be substantially elongated. The aerosol forming article may have a length and a circumference substantially perpendicular to the length. The aerosol forming article may have a total length between approximately about 30 millimeters and approximately about 100 millimeters. The aerosol forming article may have an external diameter between approximately about 5 millimeters and approximately about 12 millimeters. More preferably, The aerosol forming article may have an external diameter between approximately about 5 millimeters and approximately about 8 millimeters.

In all the aspects of the invention, preferably, the sheet including a material containing alkaloids is a homogenized tobacco sheet, where the material containing alkaloids is tobacco containing nicotine.

Specific embodiments will be further described, by way of example only, with reference to the accompanying drawings in which.

Figure 1:
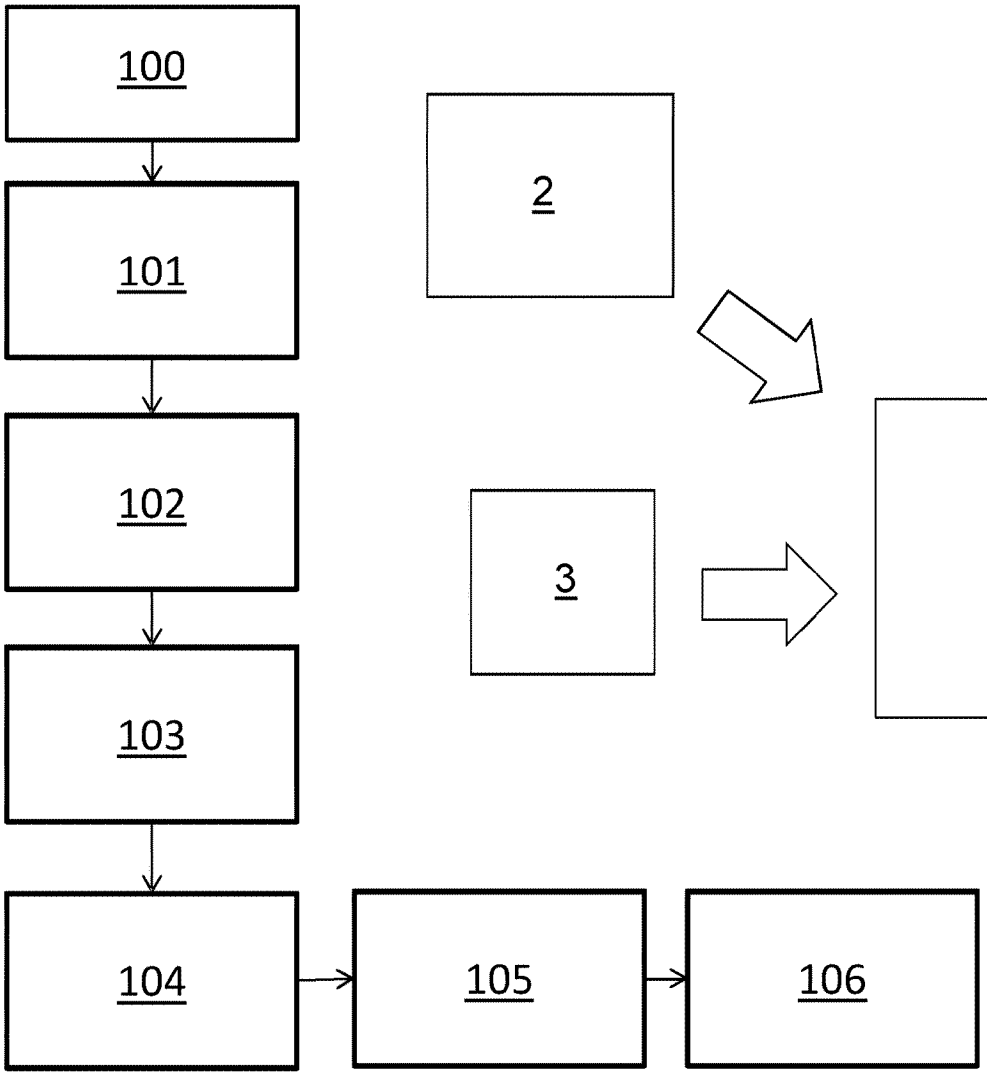
FIG. 1 shows a flow diagram of a method to produce a sheet of homogenized tobacco material according to the invention.

With initial reference to FIG. 1, the method for the production of a sheet of material containing alkaloids 200 is shown. In the shown embodiments, the sheet of material containing alkaloids 200 is a homogenized tobacco sheet and the material containing alkaloids is tobacco.

The first step of the method of the invention is the selection 100 of the tobacco types and tobacco grades to be used in the tobacco blend for producing the homogenized tobacco material. Tobacco types and tobacco grades used in the present method are for example bright tobacco, dark tobacco, aromatic tobacco and filler tobacco.

The selected tobacco types and tobacco grades intended to be production of the used for the homogenized tobacco material undergo the processing according to following steps of the method of the invention.

The method includes a further step 101 in which the selected tobacco is laid down. This step may comprise checking the tobacco integrity, such as grade and quantity, which can be for example verified by a bar code reader for product tracking and traceability. After harvesting and curing, the leaf of tobacco is given a grade, which describes for example the stalk position, quality, and colour.

Further, the lay down step 101 might also include, in case the tobacco is shipped to the manufacturing premises for the production of the homogenized tobacco material, de-boxing or case opening of the tobacco boxes. The de-boxed tobacco is then preferably fed to a weighing station in order to weight the same.

Moreover, the tobacco lay down step 101 may include bale slicing, if needed, as the tobacco leaves are normally compressed into bales in shipping boxes for shipping.

The following steps are performed for each tobacco type, as detailed below. These steps may be performed subsequently per grade such that only one production line is required. Alternatively, the different tobacco types may be processed in separate lines. This may be advantageous where the processing steps for some of the tobacco types are different. For example, in conventional primary tobacco processes bright tobaccos and dark tobaccos are processed at least partially in separate processes, as the dark tobacco often receives an additional casing. However, according to the present invention, preferably, no casing is added to the blended tobacco powder before formation of the homogenized tobacco web.

Further, the method may include a step 102 of grinding of the tobacco leaves. The grinding step 102 may be a single grinding step or a double grinding step, where the tobacco is firstly coarse grinded and then finely grinded.

Preferably, after the grinding step 102, a step of removal of non-tobacco material from the powder is performed (not depicted in FIG. 1). This removal step may be performed before grinding. Removing the non-tobacco material may be easier before grinding because the non-tobacco material may be more easily recognisable and removed than after grinding.

Preferably, after the grinding step 102, the tobacco particles are transported, for example by pneumatic transfer, to a blending step 103.

Figure 2:
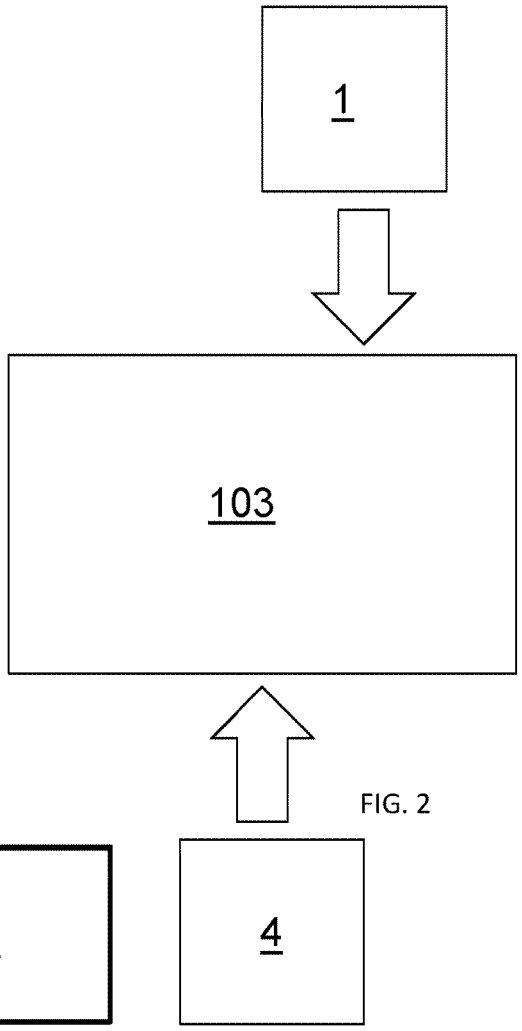
FIG. 2 shows an enlarged view of one of the steps of the method of FIG. 1.

In the blending step 103, all the grinded tobacco particles of the different tobacco types selected for the tobacco blend are blended. The blending step 103 therefore is a single step for all the selected tobacco types. This means that after the step of blending there is only need for a single process line for all of the different tobacco types. In FIG. 2, the blending of four coarse grinded tobacco particles of four different tobacco types selected for a tobacco blend, respectively schematically indicated by boxes 1, 2, 3 and 4, is represented.

In the blending step 103, preferably mixing of the various tobacco types in particles is performed. Preferably a step of measuring and controlling one or more of the properties of the tobacco blend is performed.

Alternatively, the steps 102 is performed after the blending step 103, where the various tobacco types are blended together to form the desired blend. If performed after the blending step, the process may be faster.

It is to be understood that each tobacco type could be itself a sub-blend, in other words, the "bright tobacco type" could be for example a blend of Virginia tobacco and Brazil flue-cured tobacco of different grades.

The so obtained tobacco powder can be immediately used to form the tobacco slurry. Alternatively, a further step of storage of the tobacco powder, for example in suitable containers may be inserted (not shown).

From step 103 of fine blending, the tobacco powder is used in a subsequent slurry preparation step 104. The slurry preparation step 104 preferably comprises adding together an aerosol-former, a binder, and the grinded tobacco powder in a slurry mixing tank. More preferably, this step also includes processing the slurry with a high shear mixer to ensure uniformity and homogeneity of the slurry.

Preferably, the slurry preparation step 104 also includes a step of water addition, where water is added to the slurry to obtain the desired viscosity and moisture.

The slurry composition after step 104 is the following:

Water: 30%-55%

Tobacco powder: 40%-70%

Binders: 0%-1%

Aerosol-former: 1%-5%

Added fibers: less than 0.5%

In order to form the homogenized tobacco sheet 200, preferably the slurry formed according to step 104 is cast in a casting or application step 105. Preferably, this casting step 105 includes transporting the slurry to a casting station and applying the slurry on a substrate sheet 11 (shown in FIGS. 3-6).

The homogenized cast sheet 200 is then dried in a drying step 106 comprising a uniform and gentle drying of the cast web. Preferably the drying step comprises monitoring the cast leaf temperature at each drying zone to ensure a gentle drying profile at each drying zone.

Figure 3:
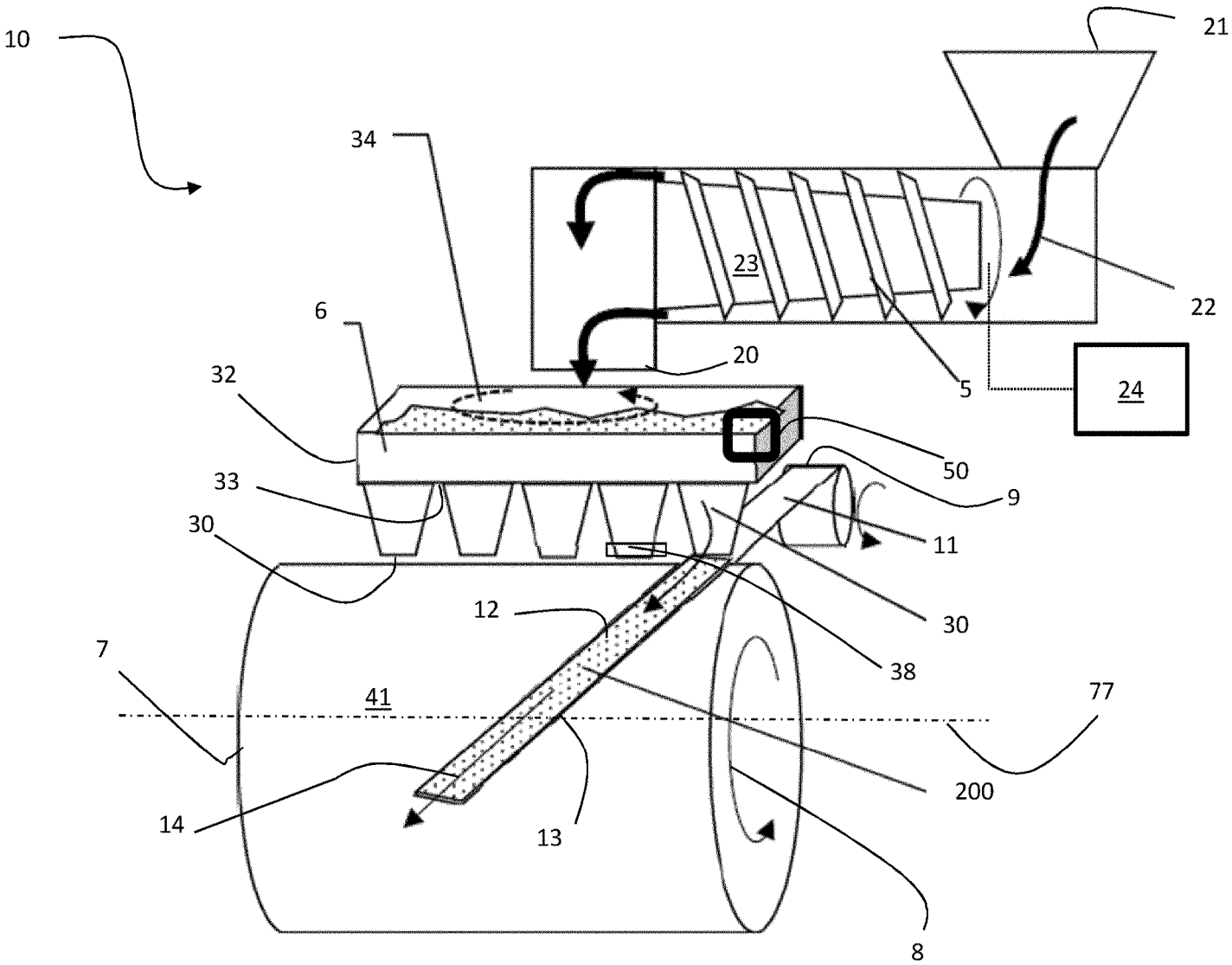
FIG. 3 shows a schematic perspective view of a first embodiment of an apparatus for production of a sheet of a material containing alkaloids according to the invention.

With now reference to FIG. 3, a first embodiment of an apparatus for the production of a sheet of homogenized tobacco 200 according to the present invention is represented and indicated with reference number 10.

Preferably, the apparatus 10 is adapted for the production of a plurality of sheets of homogenized tobacco material 200.

The apparatus 10 for the production of a sheet of homogenized tobacco material includes an extruder 5, a tank 6 positioned at an outlet 20 of the extruder 5 and a moving drum 7 located below the tank 6.

The extruder 5 comprises an inlet 21 where slurry 22 (indicated by an arrow in FIG. 3) to form the sheet of homogenized tobacco material is introduced, a screw 23 to extrude the slurry 22, and the outlet 20. The slurry 22 is pushed by the screw 23 from the inlet 21 to the outlet 20 (see again arrows 22 in FIG. 3). The screw 23 pushing the slurry 22 may be rotated by a motor 24, depicted schematically in FIG. 3 as a rectangle.

Slurry 22 reaches the extruder 5 from a different storing tank or silo, not shown in the appended drawings. Slurry 22 comprises tobacco powder, water, a binder and an aerosol former. Preferably the binder is guar. Preferably, the aerosol former is glycerine. Preferably, no further fibres are added in the slurry. Slurry is formed as described in step 104.

From the extruder 5, the slurry 22 reaches the tank 6. From the above composition, about 5 percent of water is removed from the slurry by the extrusion process.

The tank 6 comprises a plurality of outlets all indicated with 30. Tank 6 may have any geometrical shape, and in the depicted embodiment it is substantially a basin. Tank 6 includes lateral walls 32 and also further includes a bottom wall 33. A mixer 34 (indicated by an arrow in FIG. 3) can be present inside the tank 6 to stir and mix the slurry 22.

Further, a sensor 50 is present in the tank 6 to measure the vertical level of the slurry 22. Preferably, a feedback is present between the sensor 50 and the extruder 5 so that the slurry is kept in the tank 6 at a substantially constant level.

Below outlet 30, the moving drum 7 is located. Moving drum 7 is adapted to rotate around its axis 77 in a direction of rotation 8 indicated by an arrow in FIG. 3. Moving drum 7 defines an external cylindrical surface 41.

Further, the apparatus 10 includes a plurality of bobbins 9 (a single bobbin is depicted in FIG. 3). Each bobbin 9 of the plurality is made of coils of a substrate sheet 11, for example a cellulose fibres sheet. The bobbin is unwound and the free portion of the sheet 11 unwound from the bobbin 9 is positioned in contact with moving drum 7. The substrate sheet 11 includes a first and a second surface 12, 13, one opposite to the other. The second surface 13 is preferably in contact with cylindrical surface 41 of the moving drum 7. The first surface 12 faces at least one of the plurality of outlets 30. The rotation of the moving drum 7 causes a movement of the plurality of substrate sheets 11 along a common transport direction, indicated with arrow 14 in FIG. 3. The bobbins 9 are thus continuously unwound by the rotation of drum 7.

Each substrate sheet 11 of the plurality is in contact with the surface 41 of the moving drum 7 and, downstream the drum 7 along the transport direction, is free standing, that is, the first and second surfaces 12, 13 are not supported by any element. A further drum or roller (not visible in the drawing) may further pull the plurality of sheets 11 in the transport direction 14.

From the outlets 30, the slurry 22 is supplied to the plurality of substrate sheets 11. Preferably, each outlet 30 of the plurality of outlets supplies slurry 22 to a single substrate sheet 11 of the plurality of sheets. The slurry is delivered from the outlets 30 by gravity or applying pressure, for example by means of pump (not shown in the drawings). Preferably, the pump comprises a control (not visible in the drawing) of flow rate to control the amount of slurry delivered to the substrate sheet 11.

When the substrate sheet 11 is supplied with slurry 22, it becomes a homogenized tobacco sheet 200. The slurry may be absorbed by the substrate sheet 11 partly or completely. Most of the slurry may coat the substrate sheet 11, in particular the first surface 12.

Also the second surface 13 may be supplied with slurry 22.

Each outlet 30 preferably terminates with a nozzle 38 where the outlet 30 is present.

Further, preferably additional sensors (not shown) are arranged at the substrate sheet 200 downstream the outlets 30 to measure the weight per square centimetre and the thickness of the homogenized tobacco sheets 200. The sensor may be for example a nucleonic measuring head.

Additional sensors, not shown in the drawings, are preferably present as well, such as a sensor to locate and determine the positions of defects in the sheet of homogenized tobacco. A sensor to determine the moisture of the sheets 200 may be added. A sensor to measure a thickness of the sheet may be present. A sensor to check the alignment of the sheets in order to avoid misaligned and jammed sheets in case more than a single sheet is formed may be added.

The functioning of the apparatus 10 for forming the plurality of homogenized tobacco sheets 200 is as follows. Slurry 22, formed preferably mixing and combining tobacco powder, water and other ingredients, preferably with no or low content of added fibres, as described in step 104, is transferred from a storing tank (not shown) using for example in line mixers (also not shown) to the extruder 5. The slurry reduces its water contents at the extruder 5 and it is extruded inside the tank 6. In tank 6, the slurry reaches outlets 30, with or without the needs of pump. Nozzle 38 supplies slurry onto substrate sheet 11 including fibres which is positioned in contact to moving drum 7. Movements of drum 7 causes the shift of substrate sheets 11 along transport direction 14. Each nozzle 38 deposits slurry on a different substrate sheet 11. A plurality of homogenized tobacco sheets 200 is thus formed.

The thickness of the sheets 200 and grammage controlled by nucleonic gauge immediately after slurry supply are preferably continuously monitored and feedback-controlled using slurry measuring device.

Figure 4:
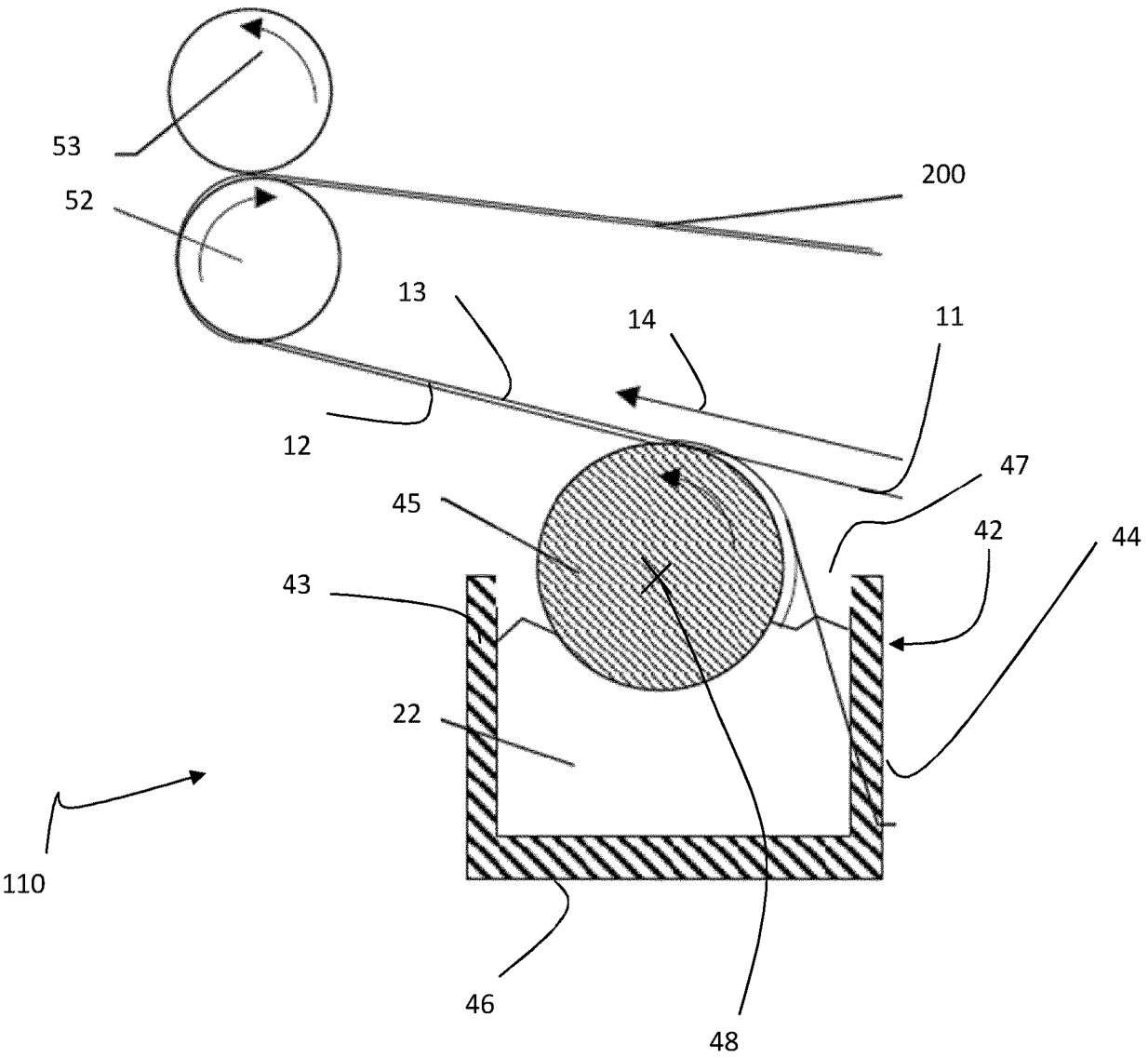
FIG. 4 shows a schematic lateral view in section of a second embodiment of an apparatus for production of a sheet of a material containing alkaloids according to the invention.

In FIG. 4, a second embodiment of an apparatus 110 for the production of the homogenized tobacco sheet 200 is shown. The apparatus 110 comprises a casting box 42 containing slurry 22 and a substrate sheet 11, wherein a casting roller 45—associated to the casting box 42—casts the slurry 22 contained in the casting box 42 onto the substrate sheet 11 so as to form the cast sheet 200 of homogenized tobacco material. Slurry 22 is prepared as in step 104 above described. Substrate sheet 11 is wound around moving rollers (only roller 52 is shown) and is positioned above casting box 42. The substrate sheet 11 defines a first surface 12 and a second surface 13 and is moved by the moving rollers 52 in a transport direction 14 indicated with an arrow in FIG. 4.

The casting box 42 comprises side walls including a first wall 43 and a second opposite wall 44. The casting box 42 is generally defined by four side walls, that is, the first wall 43 and second opposite wall 44 and a third wall and a fourth opposite wall (not shown in the figures), which connect the first wall 43 and second opposite wall 44.

Further, casting box 42 includes a bottom wall 46. It also includes an aperture 47, in this case coinciding with a top of the casting box. The aperture 47 is positioned in proximity of the substrate sheet 11.

The incoming slurry 22 is introduced into the casting box 42 from an inlet (not visible), in particular the end of a pipe, for example connected to one of the side walls of the casting box.

The slurry 22 from buffer tanks (not shown in the drawings) is transferred into the casting box 42 usually by means of a pump (not shown in the drawings). Preferably, the pump comprises a control (not visible in the drawing) of flow rate to control the amount of slurry 22 introduced in the casting box 42. The pump is advantageously designed to ensure that slurry transfer times are kept to the minimum necessary.

The amount of slurry 22 in the casting box 42 has a pre-determined level, which is preferably kept substantially constant or within a given range. In order to keep the amount of slurry 22 substantially at the same level, the pump controls the flow of slurry 22 to the casting box 42.

The casting roller 45 is associated to the casting box 42 in order to cast the slurry. The casting roller 45 has a dominant dimension which is its longitudinal width. The casting roller defines a first rotation axis 48 (indicated with a cross in FIG. 4) which corresponds to its longitudinal direction. Preferably first rotation axis 48 is horizontal and more preferably perpendicular to the casting direction 17.

The casting roller 45 is attached in a rotatable manner to the casting box 42, preferably by means of its ends, to two opposite side walls. Further, the casting roller 45 protrudes partially from aperture 47 and faces substrate sheet 11 (see in detail FIG. 4).

Between the casting roller 45 and the substrate sheet 11 a gap may be present, the dimensions of which determine—among others—the thickness of the cast web 200 of homogenized tobacco material.

The slurry 22 is cast on the substrate sheet 11 through the casting roller 45, which creates a continuous sheet 200 of homogenized tobacco material. The slurry is cast on the first surface 12 of the substrate sheet 11 facing the roller 45.

The thickness of the sheet may be further controlled by lamination rollers 52, 53. Moving roller 52 may be part of a couple of lamination rollers 52, 53 having a gap therebetween where the sheet 200 is inserted. Lamination Rollers 52, 53 are used in order to facilitate the absorption and wetting of the cellulose fibers of the substrate sheet 11 and to achieve a control of the final thickness of the sheet 11.

The cast sheet 200 is driven by the moving rollers 52 along the transport direction 14 and enters a heating unit (not shown in the figures), where it is progressively heated and homogeneously dried. The functioning of the apparatus 110 for forming the homogenized tobacco sheets 200 is as follows. Slurry 22, formed preferably mixing and combining tobacco powder, water and other ingredients, preferably with no or low content of added fibres, as described in step 104, is transferred from a storing tank (not shown) using for example in line mixers (also not shown) to the casting box 42. Casting roller 45 supplies slurry onto fibres containing substrate sheet 11 by rotating while the substrate sheet 11 moves along transport direction 14. A layer of slurry is thus deposited on the first surface 12 of the substrate sheet 11 forming a homogenized tobacco sheet 200.

The thickness of the sheets 200 and grammage controlled by nucleonic gauge immediately after slurry supply are preferably continuously monitored and feedback-controlled using a slurry measuring device.

Figure 5:
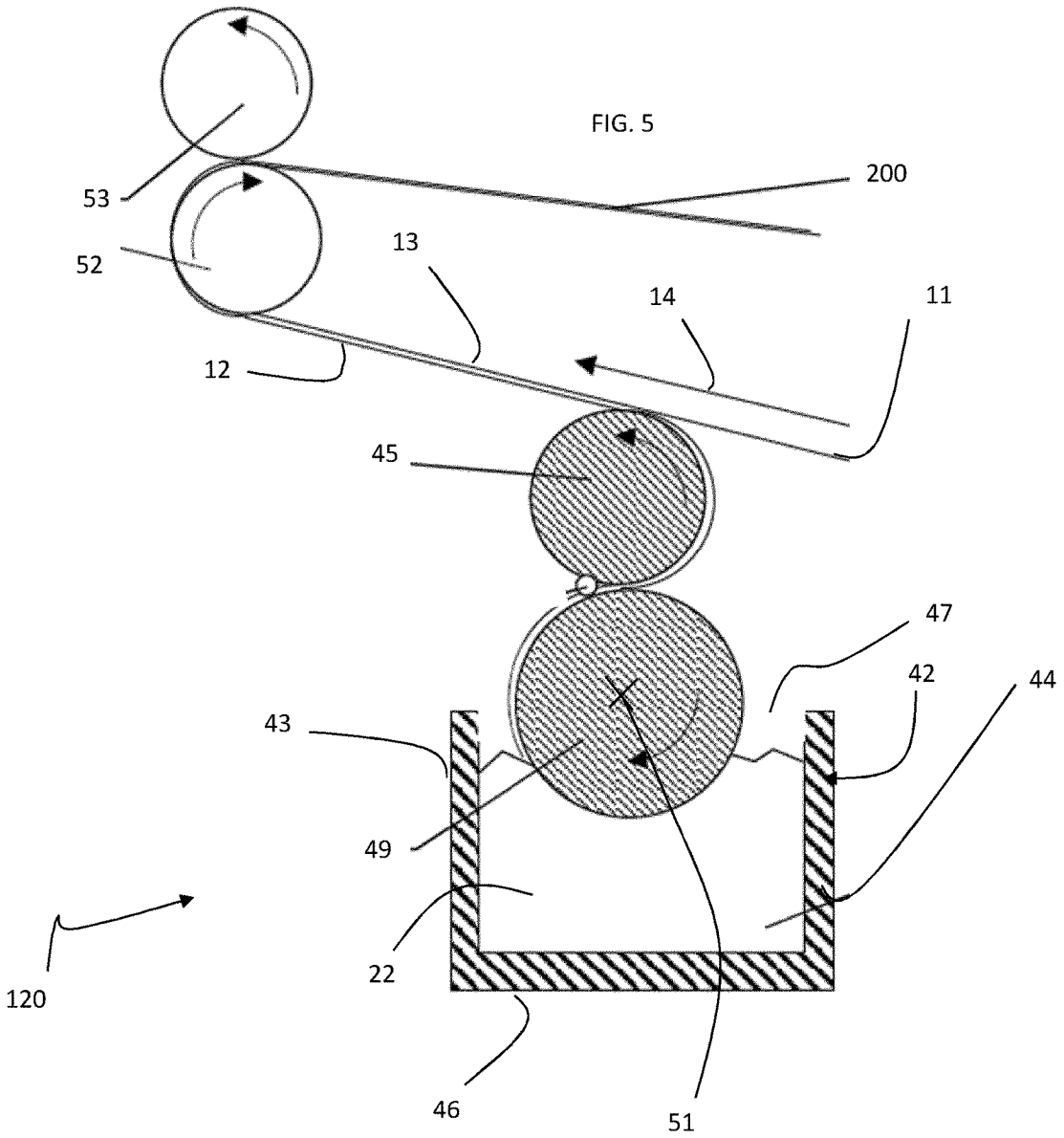
FIG. 5 shows a schematic lateral view in section of a third embodiment of an apparatus for production of a sheet of a material containing alkaloids according to the invention.

In FIG. 5, a third embodiment of an apparatus 120 for the production of the homogenized tobacco sheet 200 is shown. The apparatus 120 is similar to apparatus 110 of FIG. 4, so only differences between the two apparatuses will be outlined.

In addition to the casting roller 45, apparatus 120 comprises, in the casting box 42, also a second roller, transfer roller 49. The transfer roller 49 is located below the casting roller 45. The transfer roller 49 preferably has a diameter bigger than a diameter of the casting roller 45. Preferably, transfer roller 49 is cylindrical and defines a second rotation axis 51 (indicated with a cross in FIG. 5) parallel to first rotation axis 48. The transfer roller 49 is attached in a rotatable manner to two opposite side walls of the casting box 42, preferably by means of its longitudinal ends. Further, the transfer roller 49 is preferably located within casting box 42 in its entirety and it is submerged by slurry 22 at least in part. The rotation direction of the transfer roller 49 is opposite to the rotation direction of casting roller 45.

Between the casting roller 49 and the casting roller 45, a gap is formed.

The transfer roller 49 thus is in contact with the slurry and transfers it to casting roller 45 which applies the slurry to the substrate sheet 11 as detailed with reference to apparatus 110.

In the functioning of the apparatus 120, the slurry 22 is supplied to the casting box 42 at the inlet. The slurry reaches a given level. The transfer roller 49 is partially in contact with the slurry 22 in the casting box when it reaches the given level and, due to its rotation, it covers its outer surface with a layer of slurry 22, so that there is a slurry coating on transfer roller 49. This slurry coating in transfer roller 49 is transferred to the casting roller 45. The slurry is then transferred to casting roller 45 due to the contact between slurry layer on transfer roller 49 and the surface of casting roller 45, and a slurry coating layer is formed on the surface of casting roller 45 before its final transfer to substrate sheet 11.

Casting roller 45 rotates around axis 48 and the slurry layer touches substrate sheet 11. This causes a transfer of the slurry from casting roller 45 to substrate sheet, where the slurry coating forms the cast web 200.

The web is then preferably dried and wound up into bobbins for storage (not shown in the figures). These bobbins are later unwound and used to create the tobacco component for aerosol generating articles.

Figure 6:
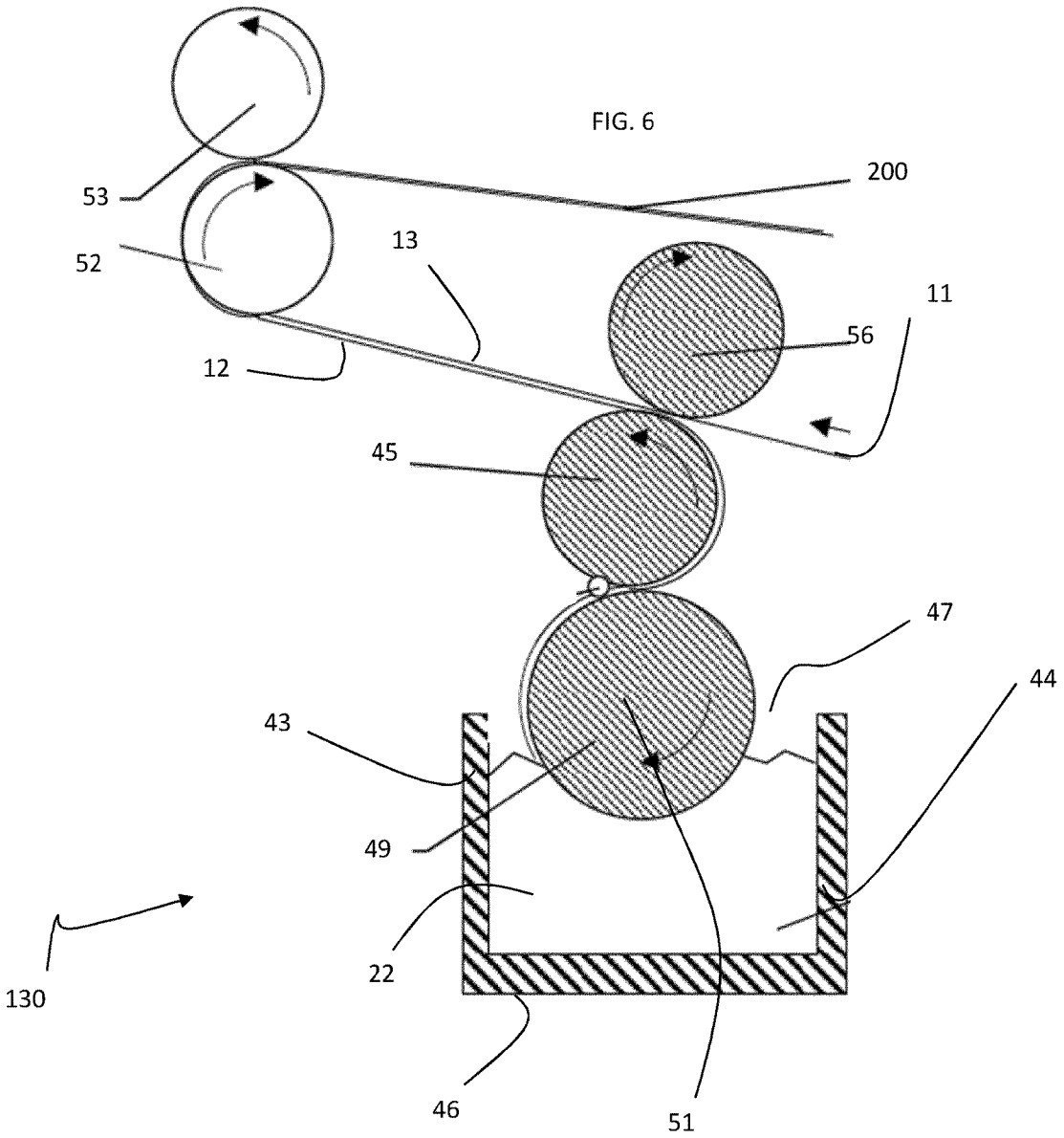
FIG. 6 shows a schematic lateral view in section of a fourth embodiment of an apparatus for production of a sheet of a material containing alkaloids according to the invention.

In FIG. 6, a fourth embodiment of an apparatus 130 for the production of the homogenized tobacco sheet 200 is shown. The apparatus 130 is similar to apparatus 120 of FIG. 5, so only differences between the two will be outlined.

The apparatus 130 includes, in addition to the configuration depicted with reference to apparatus 120, a counter pressing roller 56 located above the casting roller 45. Between the casting roller 45 and the counter pressing roller, a gap is formed. In the gap, the substrate sheet 11 is positioned. The slurry 22 cast by the casting roller 45 reaches the substrate sheet and it is pressed between the casting roller 45 and counter pressing roller 56. Casting roller 45 and counter pressing roller 56 press the first and the second surfaces 12, 13 of the substrate sheet 11, respectively.

The quantity of slurry coming out of the casting box 42 could then be controlled by adjusting the distance between the two rollers 45 and 49 (casting roller and transfer roller). The quantity of slurry applied on the substrate sheet 11 could furthermore be adjusted by controlling the pressure exerted on the sheet by the casting roller 46 and the counter pressing roller 56.

Acting on the pressure exerted on the sheet helps to have a good control on the slurry deposition on the substrate sheet 11.

The functioning of apparatus 130 is the same as apparatus 120, to which the compression by the counter pressing roller 56 is added.

Figure 7:
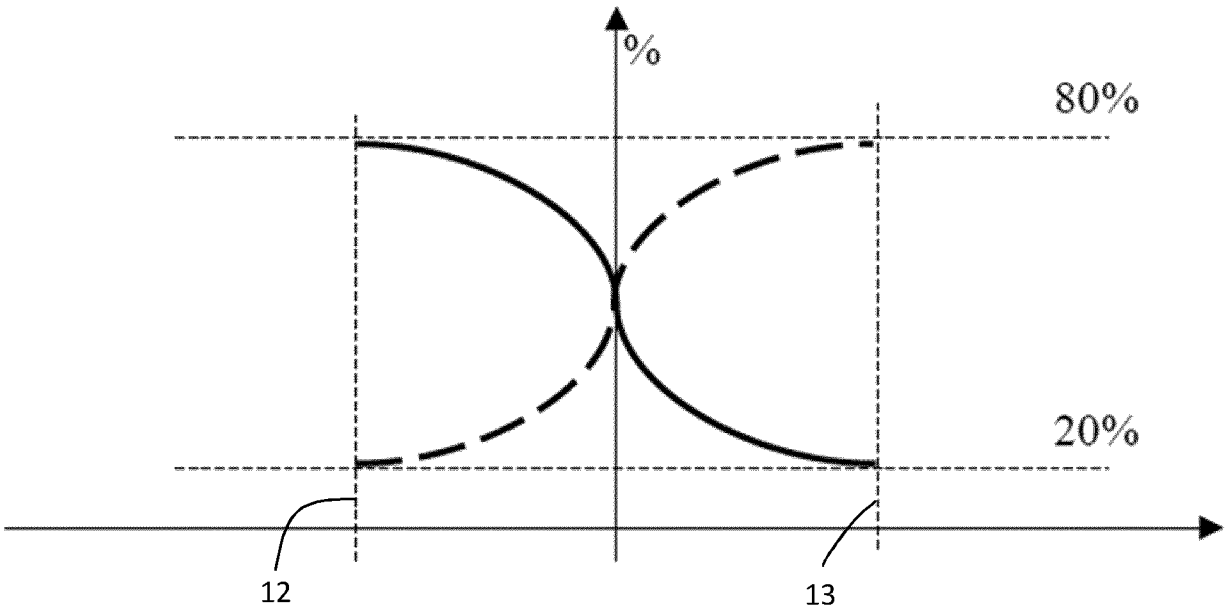
FIG. 7 shows a graph representing the composition of a cross section of a homogenized tobacco sheet produced with the method of the invention.

As depicted in FIG. 7, a graph regarding the concentration of various components of the sheet of homogenized tobacco 200 is depicted. The continuous curve represents the concentration of the slurry in the sheet, while the dashed curve represents the concentration of the material forming the substrate. The abscissa of the graph represents the position in the substrate sheet 11, from the first surface 12 of the substrate sheet to the second surface 13 of the substrate sheet. In case the slurry 22 is put on one surface, as the first surface 12, of the substrate sheet 11, the slurry will have a decreasing concentration (in percent of the mass of the tobacco sheet reported to the total mass of a unit volume) going from the first surface 12 to the second surface 13 through the substrate sheet thickness.

Such decreasing concentration could vary according to the recipe of slurry, the distribution size of the tobacco particles and the nature of the fibers substrate 11.

For instance, in the area of the first surface 12 where the slurry is applied, the slurry content could go from about 70-80 percent (in percent of the mass of the tobacco compound reported to the total mass of a unit volume) down to about 25-20 percent on the second surface 13. The fibers substrate may go from about 30-20 percent on the first surface 12, to about 75-80 percent in the area of the second surface 13.

The shapes of the curves in FIG. 7 is only schematic.

This configuration of the homogenized tobacco sheet 200 can be obtained using any of the apparatuses 10, 110, 120 and 130 of FIGS. 3-6.

The invention claimed is:

1. A method for the production of a sheet of a material containing alkaloids, said method comprising:

grinding a material containing alkaloids to a powder;

combining the powder with a binder, an aerosol former and water, so as to form a slurry, wherein the slurry comprises:

the powder of the material containing alkaloids in an amount of between about 40 percent and about 70 percent of the total weight of the slurry;

the water in an amount of between about 30 percent and about 55 percent of the total weight of the slurry;

the binder in an amount of between about 0 percent and about 1 percent of the total weight of the slurry; and the aerosol former in an amount of between 1 percent and about 5 percent of the total weight of the slurry; and applying the slurry to a substrate sheet including fibres so as to form a sheet of a material containing alkaloids.

2. The method according to claim 1, further comprising the step of:

drying the sheet of a material containing alkaloids to obtain a dry sheet of material containing alkaloids.

3. The method according to claim 1, wherein the step of grinding a material containing alkaloids to a powder comprises grinding a blend of tobacco of one or more tobacco types to a tobacco powder.

4. The method according to claim 3, wherein the step of grinding a blend of one or more tobacco types comprises blending tobacco of one or more tobacco types of the following tobaccos:

Bright tobacco;

Dark tobacco;

Aromatic tobacco; and

Filler tobacco.

5. The method according to claim 1, wherein the step of applying the slurry to a substrate sheet including fibres comprises providing a substrate sheet including cellulose fibres.

6. The method according to claim 1, wherein the step of applying the slurry to a substrate sheet including fibres comprises applying the slurry to a substrate sheet including fibres having a nominal average fibre length of between about 0.7 millimetres and about 50 millimetres.

7. The method according to claim 1, wherein applying the slurry to a substrate sheet including fibres so as to form a sheet of a material containing alkaloids comprises coating or impregnating the substrate sheet with the slurry.

8. The method according to claim 1, wherein applying the slurry to a substrate sheet including fibres so as to form a sheet of a material containing alkaloids comprises spraying the slurry onto the substrate sheet.

9. The method according to claim 2, wherein the substrate sheet has a thickness comprised between 0.175 millimetres and about 0.250 millimetres.

10. The method Method-according to claim 1, wherein the substrate sheet has a width of between about 100 millimetres and about 2500 millimetres.

11. The method according to claim 1, wherein grinding a material containing alkaloids to a powder comprises grinding a material containing alkaloids to a powder having a size of between about 8 microns and about 200 microns.

12. The method according to claim 1, wherein the substrate sheet defines a first and a second surface and the step of applying the slurry to the substrate sheet comprises applying the slurry to the first surface and to the second surface of the substrate sheet.

13. The method according to claim 1, comprising the step of applying a flavour to the sheet of material containing alkaloids.

14. The method according to claim 1, wherein the viscosity of the slurry is between about 18000 centipoise and about 45000 centipoise.

* * * * *